US011452410B1

(12) United States Patent
Ott

(10) Patent No.: US 11,452,410 B1
(45) Date of Patent: Sep. 27, 2022

(54) GROUT CLEANING DEVICE

(71) Applicant: Douglas Ott, Huntsville, TX (US)

(72) Inventor: Douglas Ott, Huntsville, TX (US)

( * ) Notice: Subject to any disclaimer, the term of this patent is extended or adjusted under 35 U.S.C. 154(b) by 714 days.

(21) Appl. No.: 16/432,067

(22) Filed: Jun. 5, 2019

(51) Int. Cl.

| | |
|---|---|
| ***A47L 7/00*** | (2006.01) |
| ***B08B 3/02*** | (2006.01) |
| ***B08B 7/04*** | (2006.01) |
| ***B08B 5/04*** | (2006.01) |

(52) U.S. Cl.
CPC ..... *A47L 7/0009* (2013.01); *B08B 3/024* (2013.01); *B08B 5/04* (2013.01); *B08B 7/04* (2013.01); *B08B 2203/0211* (2013.01)

(58) Field of Classification Search
CPC ..... A47L 7/0009; B08B 3/024; B08B 5/04; B08B 7/04; B08B 2203/0211
See application file for complete search history.

(56) References Cited

U.S. PATENT DOCUMENTS

| | | | |
|---|---|---|---|
| 5,898,970 | A | 5/1999 | Straiton |
| 7,406,739 | B2 | 8/2008 | Guest et al. |

*Primary Examiner* — Andrew A Horton
(74) *Attorney, Agent, or Firm* — Sanchelima & Associates, P.A.; Christian Sanchelima; Jesus Sanchelima

(57) ABSTRACT

A grout cleaning device is disclosed herein. The device comprises a cover, a connector configured on an operative top surface of the for facilitating secure connection of a pressurized water dispenser thereon. There is also an adaptor attachable to the connector for being in fluid communication with the pressurized water dispenser. The adaptor is configured for directing a jet of water from the pressurized water dispenser on a grout slit requiring cleaning. Additionally, there is a suction attachment disposed within an interior space defined by the cover for sucking a slurry of dirt and water resulting from the cleaning of the grout slit.

13 Claims, 4 Drawing Sheets

GROUT CLEANING DEVICE

BACKGROUND OF THE INVENTION

1. Field of the Invention

The present invention relates to the field of cleaning devices. In particular, the present invention relates to a cleaning device for cleaning grout slits formed between tiles and other such structural components.

2. Description of the Related Art

Grout is a mortar or paste for filling crevices, especially the gaps between wall or floor tiles. Grout can be made of any color, depending upon the color of the tiles or any other structural components between which the grout is to be applied. Over time, dirt accumulates on the grout and causes it to lose its original color. This is not desired.

Several designs for cleaning devices for cleaning grout have been designed in the past. None of them, however, are known to have a simple and compact configuration, which makes it easy and cost effective to manufacture, while at the same time also provides effective cleaning of the grout.

Applicant believes that a related reference corresponds to U.S. Pat. No. 5,898,970 filed by JOHN H. STRAITON. The Stratton reference discloses a grout and hard-surface cleaner that has a water-blast nozzle positioned on a cleaning enclosure to direct a high-pressure and low-volume jet stream of water and optional cleaning material at an attitude onto a surface being cleaned. Resilient and preferably rubberlike surfaces are provided on bottom portions of walls of the cleaning enclosure to facilitate sliding-seal contact with the cleaning enclosure and to provide sliding ease of movement with water and optional cleaning fluid to provide lubricity between the surface being cleaned and the bottom edges of the cleaning enclosure. However, the device disclosed by Stratton has a bulky and complicated configuration and includes a lot of components, which makes it costly to manufacture. Which also results in the present invention being more durable. The present invention is also effective while being easy to operate.

Applicant believes that another related reference corresponds to U.S. Pat. No. 7,406,739 filed by MICHAEL GUEST, ROGER PEDLAR, AND BRIAN J. DOLL. The Guest reference discloses a container with a lid which is provided with scorelines defining a plurality of long narrow lugs. A tab is secured by its midportion to the central portion of the lid and has at one end a plurality of fingers which respectively terminate over the lugs for pushing the lugs into the container when the tab is lifted. The displaced lugs leave parallel, narrow slits which preclude the entry of insects, such as bees, into the container. However, the device disclosed in the Guest reference has a bulky and complicated configuration and includes a lot of components, which makes it costly to manufacture. Which also results in the present invention being more durable. The present invention is also effective while being easy to operate.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a grout cleaning device having a simple and compact configuration.

It is another object of the present invention to provide a grout cleaning device that is easy and cost effective to manufacture.

It is another object of the present invention to provide a grout cleaning device that provides effective cleaning of the grout.

Further objects of the invention will be brought out in the following part of the specification, wherein detailed description is for the purpose of fully disclosing the invention without placing any limitations thereon.

BRIEF DESCRIPTION OF THE DRAWING

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
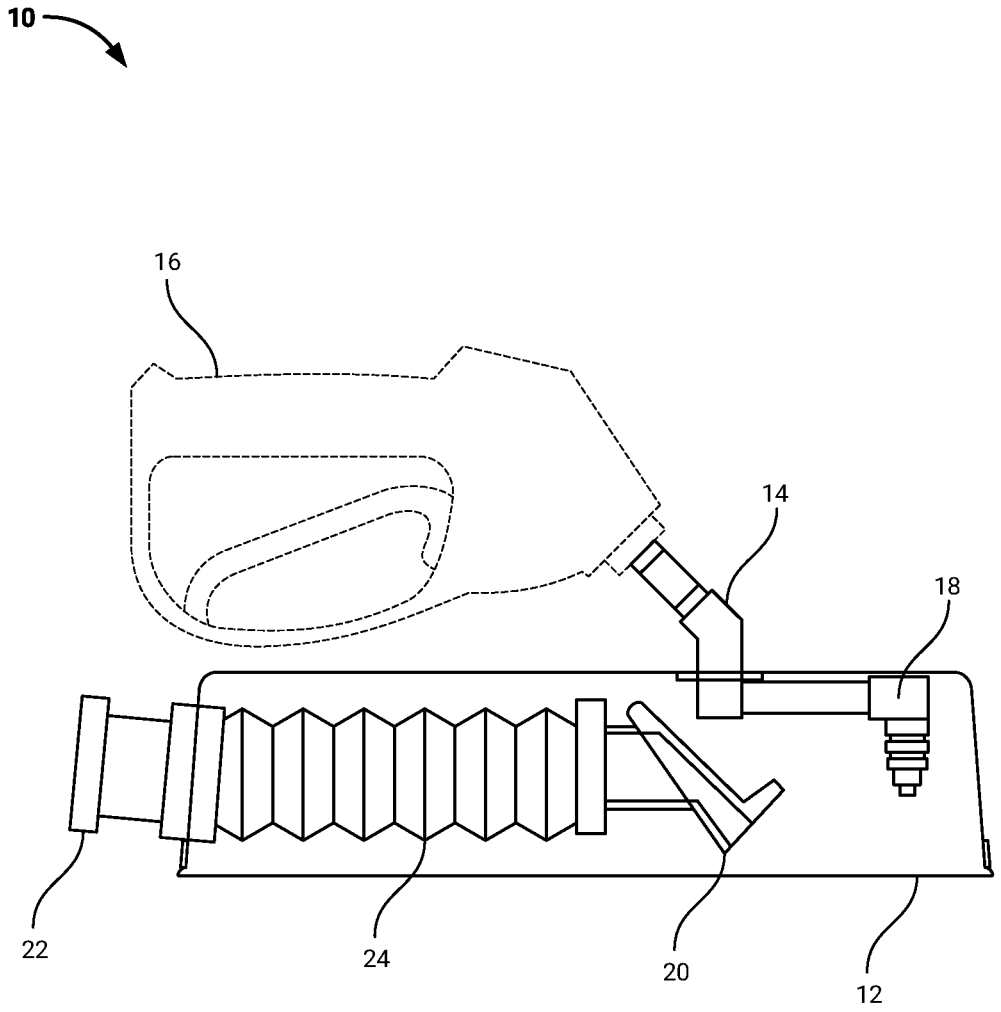
FIG. 1 shows a grout cleaning device 10, in accordance with an embodiment of present invention, wherein grout cleaning device 10 comprises a cover 12, a connector 14 configured on an operative top surface of cover 12 for facilitating secure connection of a pressurized water dispenser 16 thereon, and an adaptor 18 attachable to connector 14 for being in fluid communication with pressurized water dispenser 16.
Figure 2:
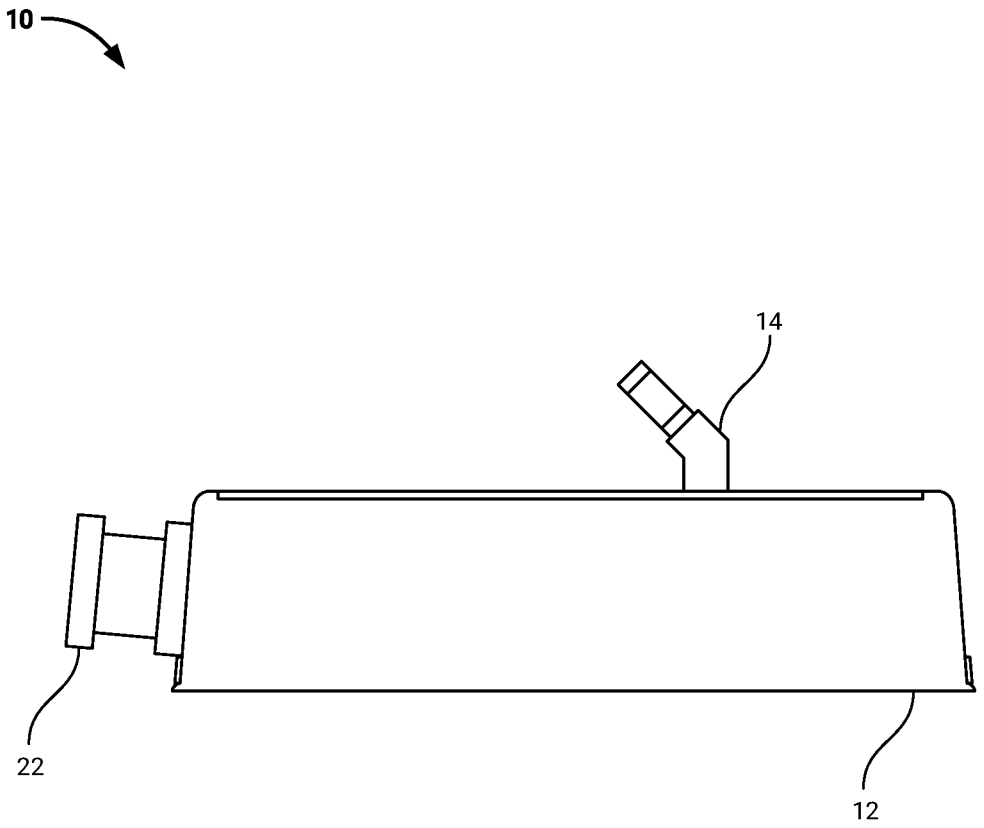
FIG. 2 illustrates a side view of grout cleaning device 10, in accordance with an embodiment of the present invention.

Referring now to FIGS. 1 through 4, where the present invention is generally referred to with numeral 10, it can be observed that a grout cleaning device 10, in accordance with an embodiment of the present invention, comprises a cover 12, a connector 14 configured on an operative top surface of cover 12 for facilitating secure connection of a pressurized water dispenser 16 thereon, and an adaptor 18 attachable to connector 14 for being in fluid communication with pressurized water dispenser 16.

Grout cleaning device 10 comprises cover 12. Cover 12 is a box like structure, which is open at one end, on the operative bottom end, to interface with the surface requiring cleaning. In accordance with an embodiment of the present invention, cover 12 has a rectangular shape. However, the shape of cover 12 is not restricted to being rectangular and cover 12 can have a cross-section of any shape and size, depending on application requirements.

Grout cleaning device 10 comprises connector 14. Connector 14 is configured on an operative top surface of cover 12 for facilitating secure connection of a pressurized water dispenser 16 thereon. Connector 14 is a protrusion extending from operative top surface of cover 12. In accordance with one embodiment of the present invention, connector 14 is a substantially L-shaped configuration. Pressurized water dispenser 16 can be any conventional pressurized water dispenser 16 connected to a water source such as a nearby faucet via a hose.

Grout cleaning device 10 further comprises adaptor 18. Adaptor 18 is a component that is in fluid communication with connector 14. More specifically, connector 14 has a hollow configuration that allows water from pressurized water dispenser 16 to flow therethrough. Adaptor 18 receives the pressurized water jet from pressurized water dispenser 16 via connector 14 and directs the water jet to the slits between tiles or any other desired location, where the removal of dirt deposited on the grout is desired.

Grout cleaning device 10 further comprises a suction attachment 20 disposed within an interior space defined by cover 12. Suction attachment 20 is a conventional suction attachment used in and connected to conventional wet and dry vacuum machines. Suction attachment 20 is selected to have a size that can easily be accommodated within interior space defined by cover 12.

An aperture 22 is configured on cover 12. Aperture 22 facilitates an entry of a suction conduit 24 inside cover 12 to connect with suction attachment 18. In accordance with an embodiment of the present invention, conduit 24 is a flexible conduit or hose.

Figure 3:
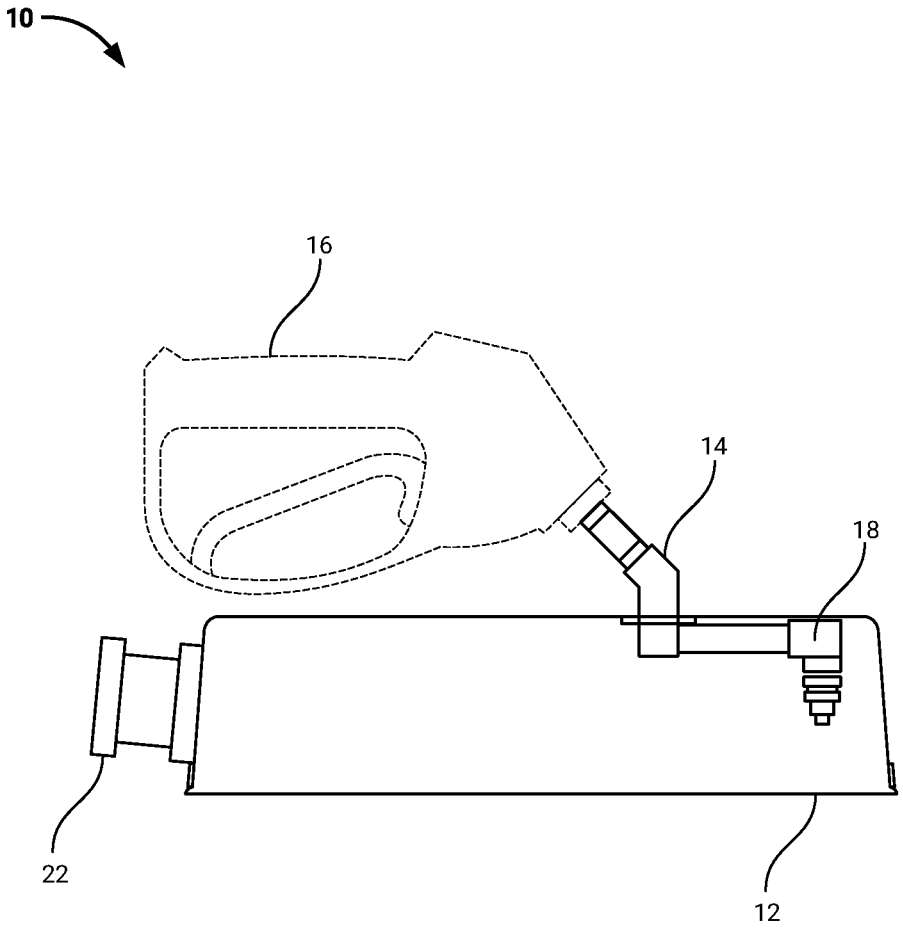
FIG. 3 shows a grout cleaning device 10, in accordance with an embodiment of the present invention.
Figure 4:
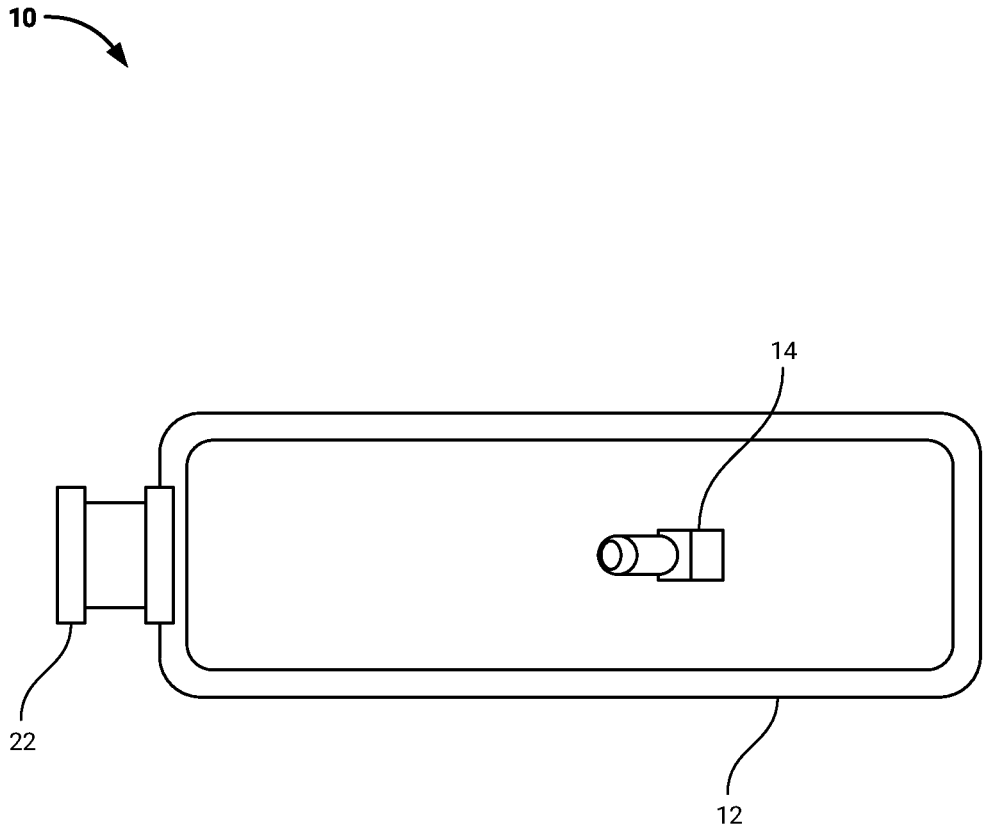
FIG. 4 illustrates a top view of grout cleaning device 10, in accordance with another embodiment of the present invention.

Another embodiment of grout cleaning device 10 is illustrated in FIG. 4. The embodiment illustrated in FIG. 3 is similar to the embodiment depicted in FIG. 1, with the only difference being that the embodiment illustrated in FIG. 3 does not include vacuum or suction means. The slurry of water and dirt resulting from cleaning of the grout is cleaned manually subsequent to the use of grout cleaning device 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A grout cleaning device comprising:

a. a cover;

b. a connector configured on an operative top surface of said cover for facilitating secure connection of a pressurized water dispenser thereon; and c. an adaptor attachable to said connector for being in fluid communication with said pressurized water dispenser, said adaptor configured for directing a jet of water from said pressurized water dispenser on a grout slit requiring cleaning.

2. The grout cleaning device according to claim 1, wherein said cover has a substantially rectangular shape.

3. The grout cleaning device according to claim 1, further comprising a suction attachment disposed within an interior space defined by said cover.

4. The grout cleaning device according to claim 3, wherein said cover comprises an aperture.

5. The grout cleaning device according to claim 4, wherein said aperture facilitates an entry of a suction conduit within said cover to connect with said suction attachment.

6. The grout cleaning device according to claim 5, wherein said suction conduit connected to said suction attachment is for a dry vacuum or a wet vacuum.

7. The grout cleaning device according to claim 1, wherein said connector is a substantially L-shaped protrusion.

8. The grout cleaning device according to claim 7, wherein said cover has a substantially rectangular shape.

9. The grout cleaning device according to claim 7, wherein said cover comprises an aperture.

10. The grout cleaning device according to claim 1, wherein a hose is connected to said pressurized water dispenser.

11. A grout cleaning device comprising:

a. a cover;

b. a connector configured on an operative top surface of said cover for facilitating secure connection of a pressurized water dispenser thereon;

c. an adaptor attachable to said connector for being in fluid communication with said pressurized water dispenser, said adaptor configured for directing a jet of water from said pressurized water dispenser on a grout slit requiring cleaning; and d. a suction attachment disposed within an interior space defined by said cover for sucking a slurry of dirt and water resulting from the cleaning of said grout slit.

12. The grout cleaning device according to claim 11, wherein said aperture facilitates an entry of a suction conduit within said cover to connect with said suction attachment.

13. A grout cleaning device comprising:

a. a cover;

b. a connector configured on an operative top surface of said cover for facilitating secure connection of a pressurized water dispenser thereon;

c. an adaptor attachable to said connector for being in fluid communication with said pressurized water dispenser, said adaptor configured for directing a jet of water from said pressurized water dispenser on a grout slit requiring cleaning;

d. a suction attachment disposed within an interior space defined by said cover for sucking a slurry of dirt and water resulting from the cleaning of said grout slit;

e. wherein said cover has a substantially rectangular shape;

f. wherein said cover comprises an aperture;

g. wherein said aperture facilitates an entry of a suction conduit within said cover to connect with said suction attachment; and h. wherein said connector is a substantially L-shaped protrusion.

* * * * *